US007794117B2

(12) United States Patent
Cheng et al.

(10) Patent No.: US 7,794,117 B2
(45) Date of Patent: Sep. 14, 2010

(54) LAMP COVER AND ILLUMINATION LAMP HAVING SAME

(75) Inventors: Yi-Kai Cheng, Miao-Li Hsien (TW); Jyh-Long Chern, Miao-Li Hsien (TW); Chih-Ming Lai, Miao-Li Hsien (TW)

(73) Assignee: Foxsemicon Integrated Technology, Inc., Chu-Nan, Miao-Li Hsien (TW)

( * ) Notice: Subject to any disclaimer, the term of this patent is extended or adjusted under 35 U.S.C. 154(b) by 61 days.

(21) Appl. No.: 12/251,683

(22) Filed: Oct. 15, 2008

(65) Prior Publication Data

US 2009/0154158 A1 Jun. 18, 2009

(30) Foreign Application Priority Data

Dec. 14, 2007 (CN) ..... 2007 1 0203089

(51) Int. Cl.
*F21V 5/04* (2006.01)

(52) U.S. Cl. ..... 362/335; 362/333; 362/336; 362/331; 362/326

(58) Field of Classification Search ..... 362/326–340, 362/311.01–311.15, 617–620, 217.02, 223, 362/235, 308–309; 359/625–626
See application file for complete search history.

(56) References Cited

U.S. PATENT DOCUMENTS 5,515,253 A * 5/1996 Sjobom ..... 362/244
5,636,057 A * 6/1997 Dick et al. ..... 359/625
5,715,619 A 2/1998 Polisois et al.
6,033,094 A * 3/2000 Sohn ..... 362/332
6,213,625 B1 * 4/2001 Leadford et al. ..... 362/331
6,540,382 B1 4/2003 Simon
6,752,505 B2 * 6/2004 Parker et al. ..... 362/627
6,793,361 B2 * 9/2004 Matsui ..... 362/97.1
7,121,693 B2 * 10/2006 Klose ..... 362/331
2004/0188593 A1 9/2004 Mullins et al.

FOREIGN PATENT DOCUMENTS

CN 1828340 A 9/2006
DE 1162308 2/1964
DE 20319107 U1 4/2004
EP 1528527 A1 5/2005
EP 1528527 B1 10/2006
GB 641386 8/1950
WO WO2006137459 A1 12/2006

* cited by examiner

*Primary Examiner*—Jong-Suk (James) Lee
*Assistant Examiner*—Robert J May
(74) *Attorney, Agent, or Firm*—Andrew C. Cheng

(57) ABSTRACT

A lamp cover includes an array of lenses. Each lens includes an incidence surface for receiving light, and an emitting surface opposite to the incidence surface. One of the incidence surface and the emitting surface is a convex surface. Each lens includes a first end and an opposite second end in a column direction, a third end and an opposite fourth end in a row direction. The lenses in each row, a thickness difference between the first end and the second end of each lens is greater than a thickness difference between the third end and the fourth end thereof. An illumination lamp is also provided in this invention.

13 Claims, 10 Drawing Sheets

LAMP COVER AND ILLUMINATION LAMP HAVING SAME

CROSS-REFERENCE TO RELATED APPLICATIONS

This application is related to commonly-assigned copending applications entitled, "lampshade and illumination lamp having the same", filed on Jan. 25, 2008 (application Ser. No. 12/019,908). Disclosures of the above identified application are incorporated herein by reference.

BACKGROUND

1. Field of the Invention

The present invention generally relates to an illumination lamp, and particularly to a lamp cover of the illumination lamp.

2. Description of Related Art

In recent years, light emitting diode (LED) as a highly efficient light source is widely used in such fields as automobiles, display screens, and traffic lights.

FIG. 9 shows a simulated view of a light field of the LED. The light field of the LED is approximately circular. An intensity of the light field of the LED gradually decreases outwardly along a radial direction. Thus, the light field intensity near the LED is higher, and the light field intensity far from the LED is lower. However, in some cases, when the LED is adopted for a street lamp, the shape of the circular-shaped light field is often different from that of the street. As a result, a lighting area of such LED projected on the street is small. Thus, more LEDs are required for lighting the street, resulting in high cost and inefficient of energy.

FIG. 10 shows a light field of a street lamp 20 using LEDs as light source. The street lamp 20 is always positioned at one side of a street 22. Because of the circular-shaped light field of the LED, some of light emitted from the LEDs only covers a portion of the street 22. Thus, the street lamp 20 has a low utilization efficiency of the light emitted from the LEDs.

For the foregoing reasons, there is a need in the art for an illumination lamp which overcomes the above-described shortcomings.

SUMMARY

A lamp cover includes an array of lenses. Each lens includes an incidence surface for receiving light, and an emitting surface opposite to the incidence surface. One of the incidence surface and the emitting surface is a convex surface. Each lens includes a first end and an opposite second end in a column direction, a third end and an opposite fourth end in a row direction. The lenses in each row, a thickness difference between the first end and the second end of each lens is greater than a thickness difference between the third end and the fourth end thereof.

Other advantages and novel features of the present invention will be drawn from the following detailed description of a preferred embodiment of the present invention with attached drawings, in which:

BRIEF DESCRIPTION OF THE DRAWINGS

Many aspects of the present lamp cover and illumination lamp can be better understood with reference to the following drawings. The components in the drawing are not necessarily drawn to scale, the emphasis instead being placed upon clearly illustrating the principles of the present lamp cover and illumination lamp. Moreover, in the drawings, like reference numerals designate corresponding parts throughout the several views.

DETAILED DESCRIPTION OF THE EMBODIMENTS

The detailed description of a light pervious lamp cover and an illumination lamp according to the present invention will now be made with reference to the attached drawings.

Figure 1:
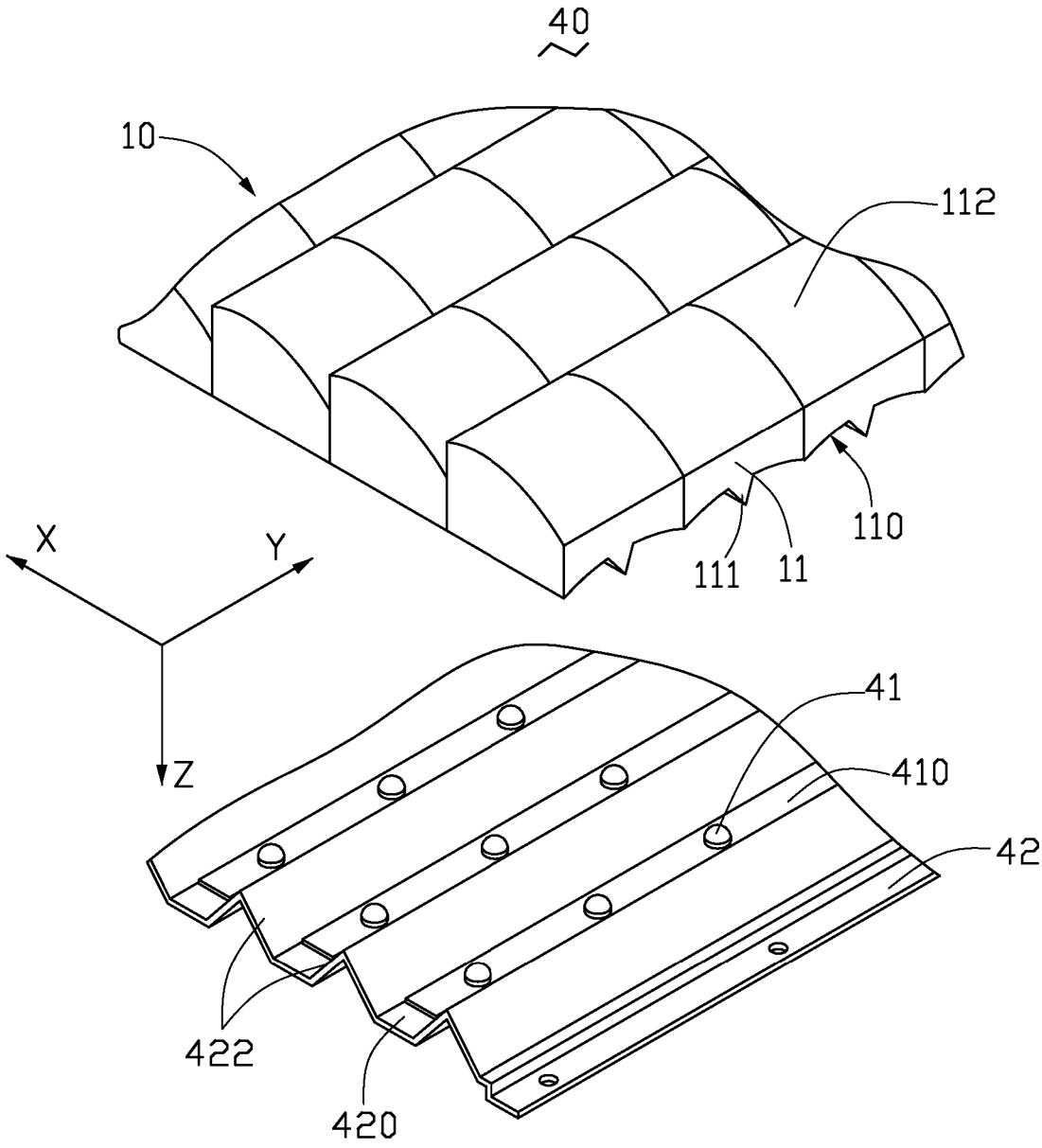
FIG. 1 is an explored, abridged general view of an illumination lamp in accordance with a first exemplary embodiment of the present invention.

Referring to FIG. 1, the illumination lamp 40 includes a plurality of lighting members 41, a plurality of circuit boards 410, a reflecting board 42 and a light pervious lamp cover 10.

The reflecting board 42 is wave-shaped. A cross section of the reflecting board 42 along the X-direction (i.e., column direction) is wave-shaped, which includes a plurality of horizontal flat sections 420 and a plurality of serrate sections 422 each interconnects with two neighboring horizontal flat sections 420. A trapezoid-shaped interspace (not labeled) is thus defined among each horizontal flat section 420 and two neighboring serrate sections 422.

Each circuit board 410 is arranged on a corresponding horizontal flat section 420, and is received in a corresponding interspace. The lighting members 41 are arranged on the circuit boards 410 and are electrically connected to the circuit board 410. Thus, when electric currents are applied to the lighting members 41 through the circuit board 410, the lighting members 41 radiate light. In this embodiment, the lighting members 41 are light emitting diodes (LEDs). The lighting members 41 are arranged on the reflecting board 42 spaced evenly from each other.

Figure 2:
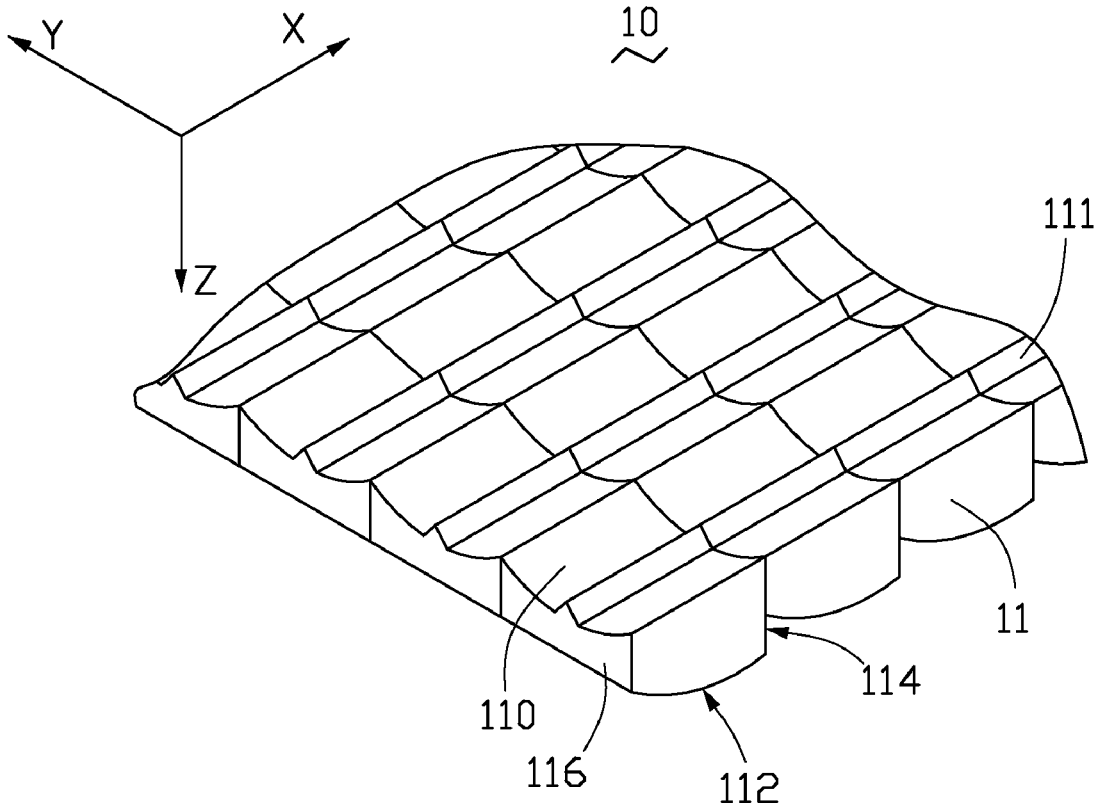
FIG. 2 is an abridged general view of a light pervious lamp cover of the illumination lamp in FIG. 1 viewed from another aspect.
Figure 3:
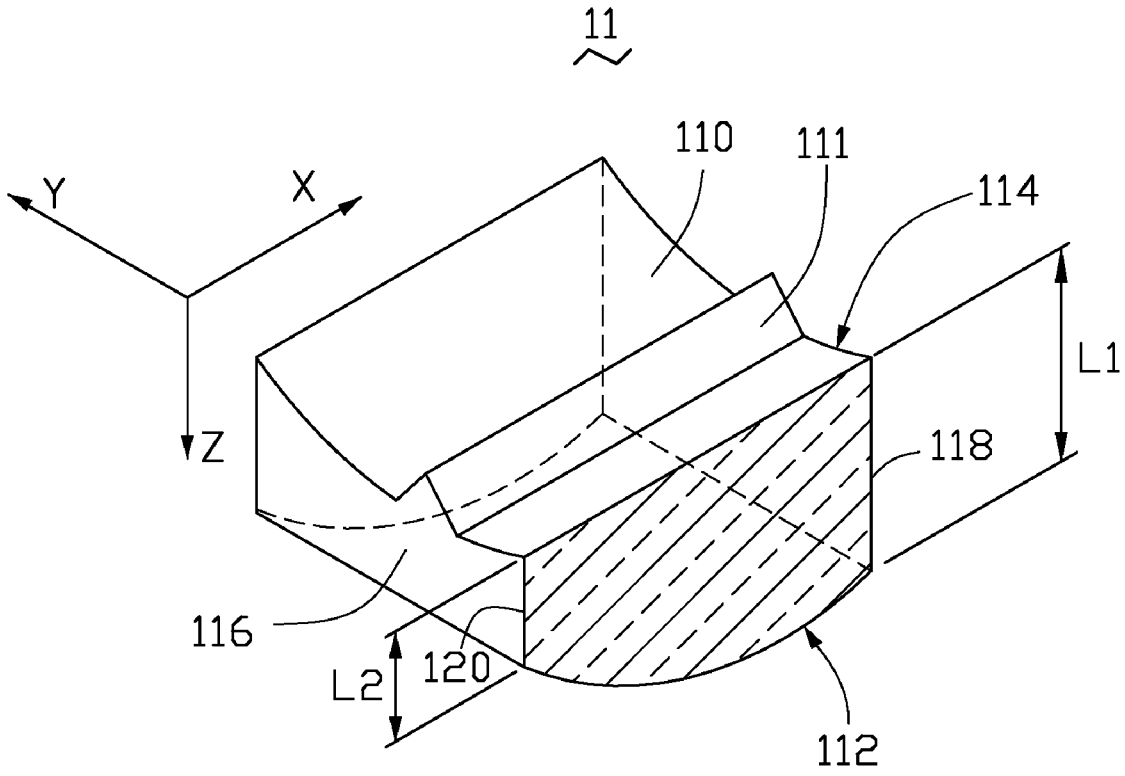
FIG. 3 is an isometric view of one lens of the lamp cover of FIG. 2.

As shown in FIGS. 2 and 3, the lamp cover 10 is arranged over the lighting members 41. The lamp cover 10 includes a plurality of lenses 11. The number of the lenses 11 is the same as that of the lighting members 41. Each lighting member 41 is arranged corresponding to one lens 11 or each lens 11 is arranged corresponding to one lighting member 41. In this embodiment, the lenses 11 are formed separately and then assembled together. Alternatively, the lenses 11 can be integrally formed.

Each lens 11 includes an incidence surface 110 facing the corresponding lighting member 41, and an emitting surface 112 opposite to the incidence surface 110. The incidence surface 110 is a concave surface configured for receiving the light of the lighting member 41. The emitting surface 112 is a convex surface configured for emitting light from the lamp cover 10 into ambient. The concave surface 110 and the convex surface 112 are column-shaped. The concave surface 110 extends along the X-direction. The convex surface 112 extends along the Y-direction (i.e., row direction). In this embodiment, the Y-direction is perpendicular to the X-direction. Each lens 11 forms a micro-structure 111 thereon. The micro-structure 111 is a long and narrow protrusion, and extends outwardly from the lens 11 along the X-direction. A cross section of micro-structure 111 along the Y-direction is triangle.

Each lens 11 has a first end surface 114 and a second end surface 116 facing away from the first end surface 114. The first end surface 114 and the second end surface 116 are both parallel with the Y-direction and adjacent to both of the concave surface 110 and the convex surface 112. A cross section of each lens 11 taken along a direction perpendicular to the Y-direction has two sides 118 and 120, which belong to the first end surface 114 and the second end surface 116, respectively. A length L1 of the side 118 is larger than a length L2 of the side 120.

During operation, when the electric currents are applied to the lighting members 41 through the circuit board 410, the lighting members 41 radiates light. The reflecting board 42 reflects part of the light to the lamp cover 10. Thus, approximately all of the light generated by the lighting members 41 enters into the lamp cover 10 through the incidence surface 110. The micro-structure 111 can increase radiating range of the light along the Y-direction when the light enters into the lamp cover 10 through an outer surface of the micro-structure 111. Conversely, the convex surface 112 is used for contracting radiating range of the light along the X-direction. Thus, the area which the illumination lamp 40 illuminates along the Y-direction is increased, and the area along the X-direction is decreased. The circular-shaped light field of the lighting members 41 is thus elongated.

Figure 4:
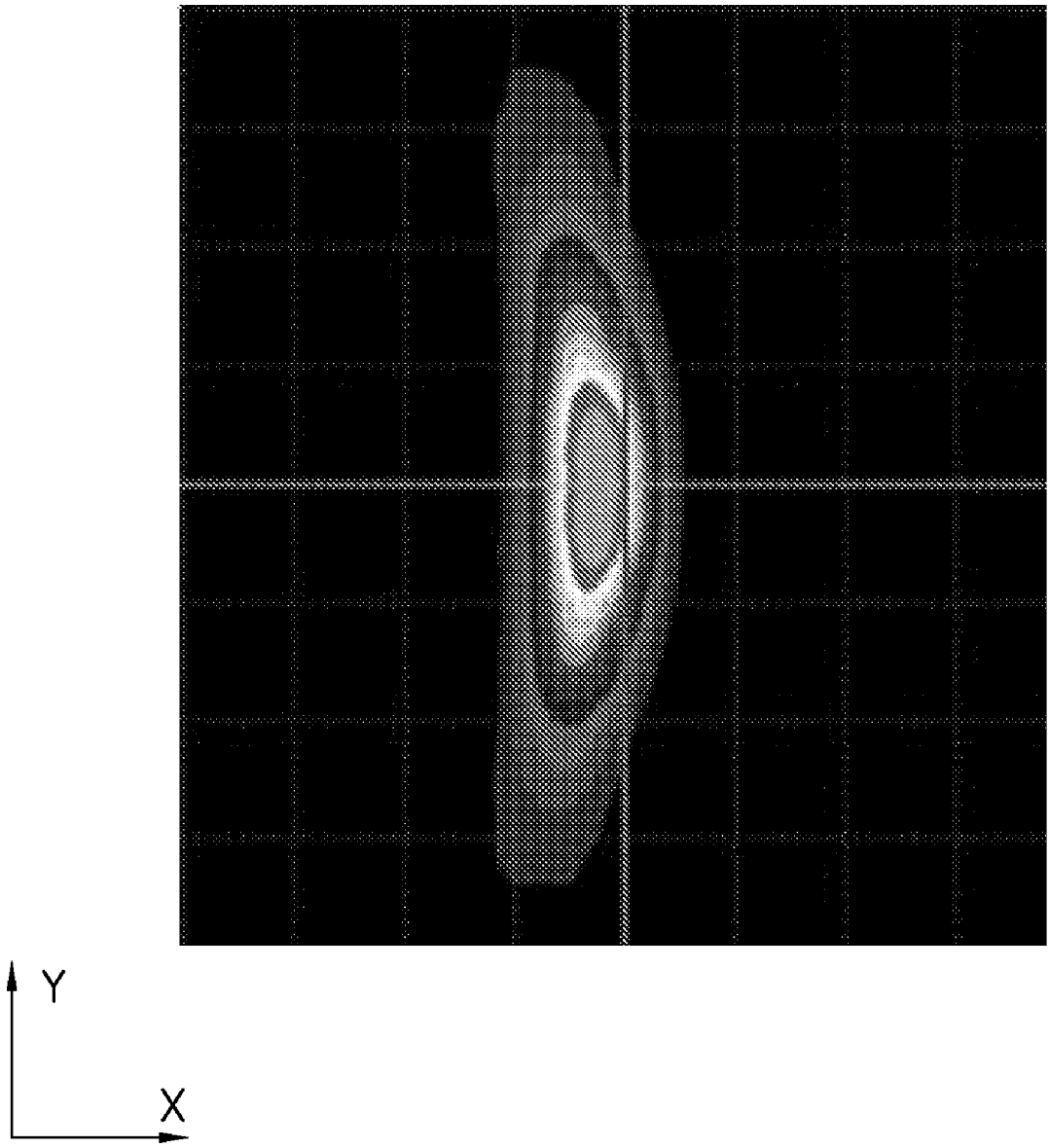
FIG. 4 is shows a simulated view of a light field of the illumination lamp incorporating the lamp cover of FIG. 1.
Figure 5:
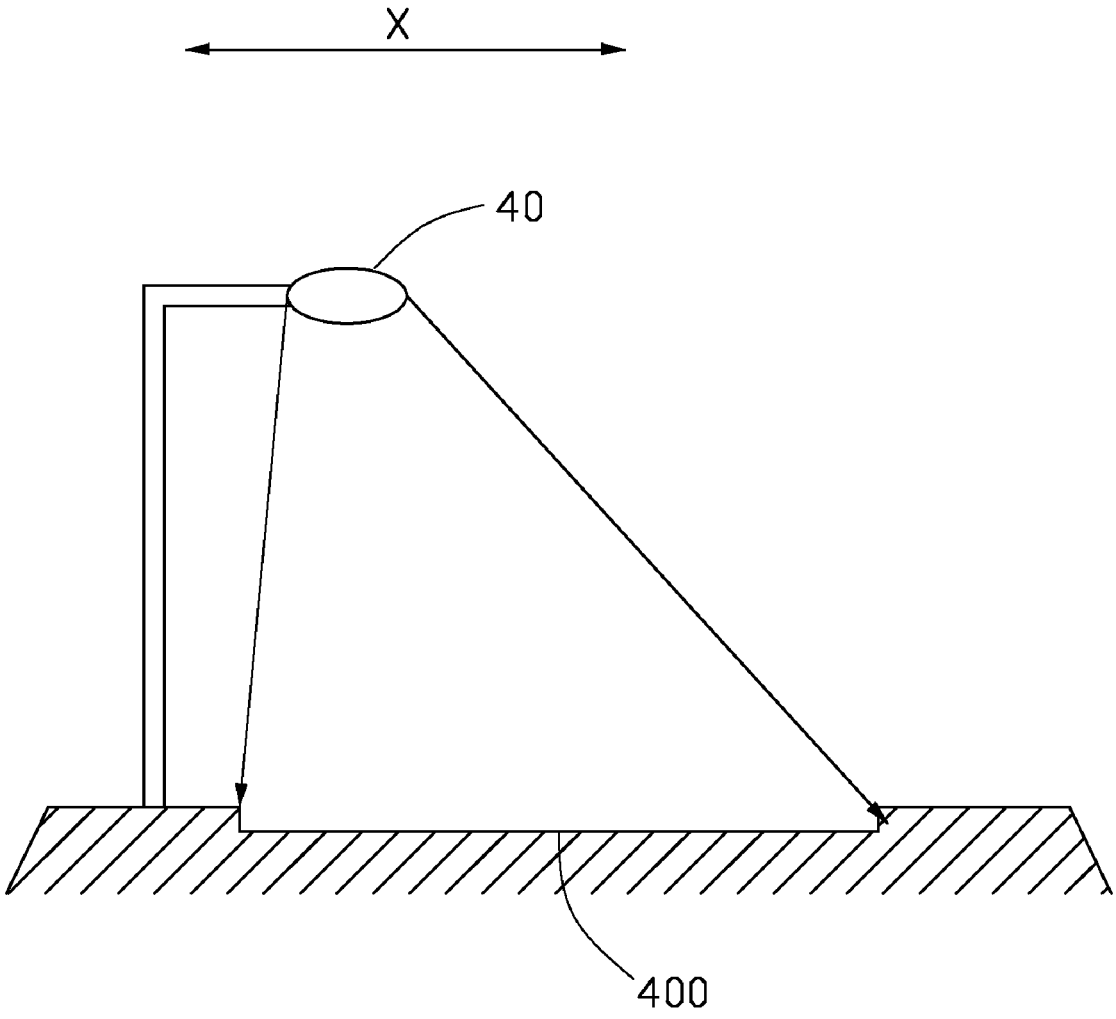
FIG. 5 shows a light field of the illumination lamp of FIG. 3, which is arranged at one side of a street.

Referring to FIG. 4, a light field adopting the lens 11 is shown. The light field along the Y-direction is increased and the light field along the X-direction is decreased. The shape of the light field is approximately the same as that of the street, thus all of the light radiating by the lighting members 41 can be utilized. In addition, because the cross section of the lens 11 has two sides 118 and 120 with different lengths, the center of the light field is off the center of the lens 11 along the X-direction. Thus, the radiating range of the lighting members 41 integrally translates a distance relative to the radiating range of the relate illumination lamp 20 along the X-direction. As shown in FIG. 5, almost all of the light emitted from the illumination lamp 40 is utilized to illuminate a street 400. Thus, the street lamp 40 has a high utilization efficiency of the light emitted from the lighting members 41.

It is to be understood that the micro-structures 111 are configured for increasing radiating range of the lighting members 41, and the number, the arrangement of the micro-structures 111 can be changed according to the shape or the size of the illumination lamp.

Figure 6:
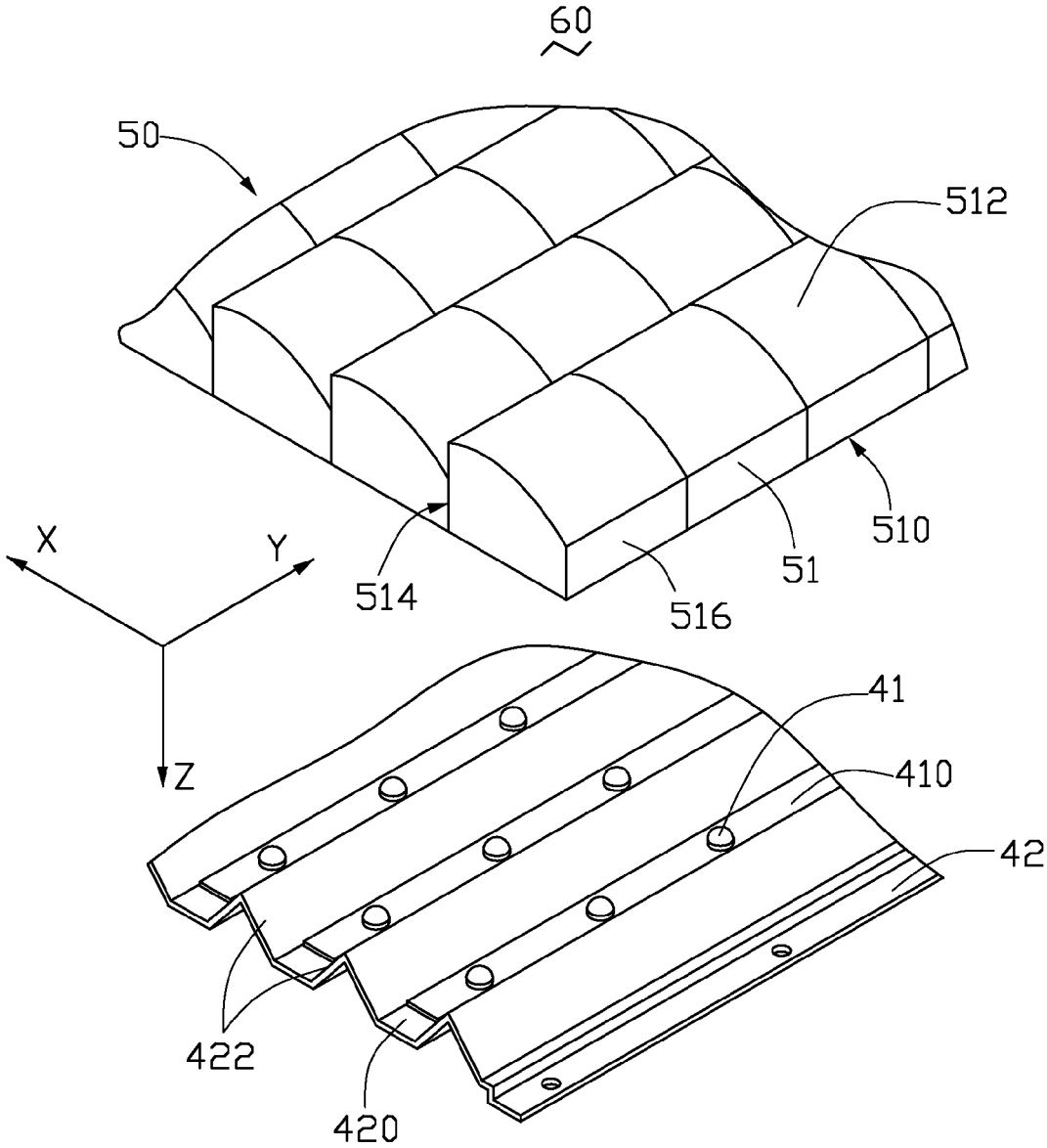
FIG. 6 is an explored, abridged general view of an illumination lamp in accordance with a second exemplary embodiment of the present invention.
Figure 7:
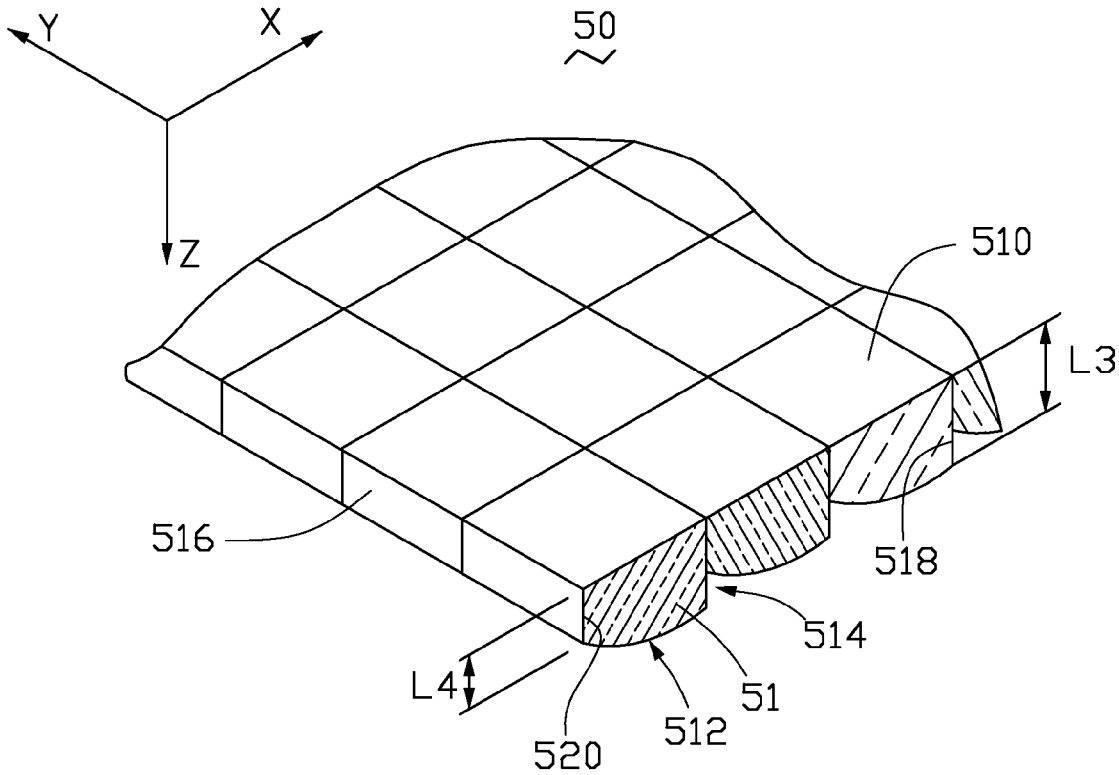
FIG. 7 an abridged general view of a light pervious lamp cover of the illumination lamp in FIG. 6 viewed from another aspect.

Referring to FIGS. 6 and 7, an illumination lamp 60 according to a second embodiment of the present invention is shown. The illumination lamp 60 includes a plurality of lighting members 41 arranged on a reflecting board 42, and a light pervious lamp cover 50 arranged over the lighting members 41. The lamp cover 50 is constructed by a plurality of lenses 51. Each lens 51 includes an incidence surface 510 facing the lighting members 41, and an emitting surface 512 opposite to the incidence surface 510. Each lens 51 has a first end surface 514 and a second end surface 516 facing away from the first end surface 514. The first end surface 514 and the second end surface 516 are both parallel with the Y-direction and adjacent to both of the incidence surface 510 and the emitting surface 512. A cross section of each lens 51 taken along a direction perpendicular to the Y-direction has two sides 518 and 520. The sides 518 and 520 belong to the first end surface 514 and the second end surface 516, respectively. A length L3 of the side 518 is larger than a length L4 of the side 520. The difference between this embodiment and the first embodiment is that the incidence surface 510 is a planar surface, and the emitting surface 512 is a convex surface.

Figure 8:
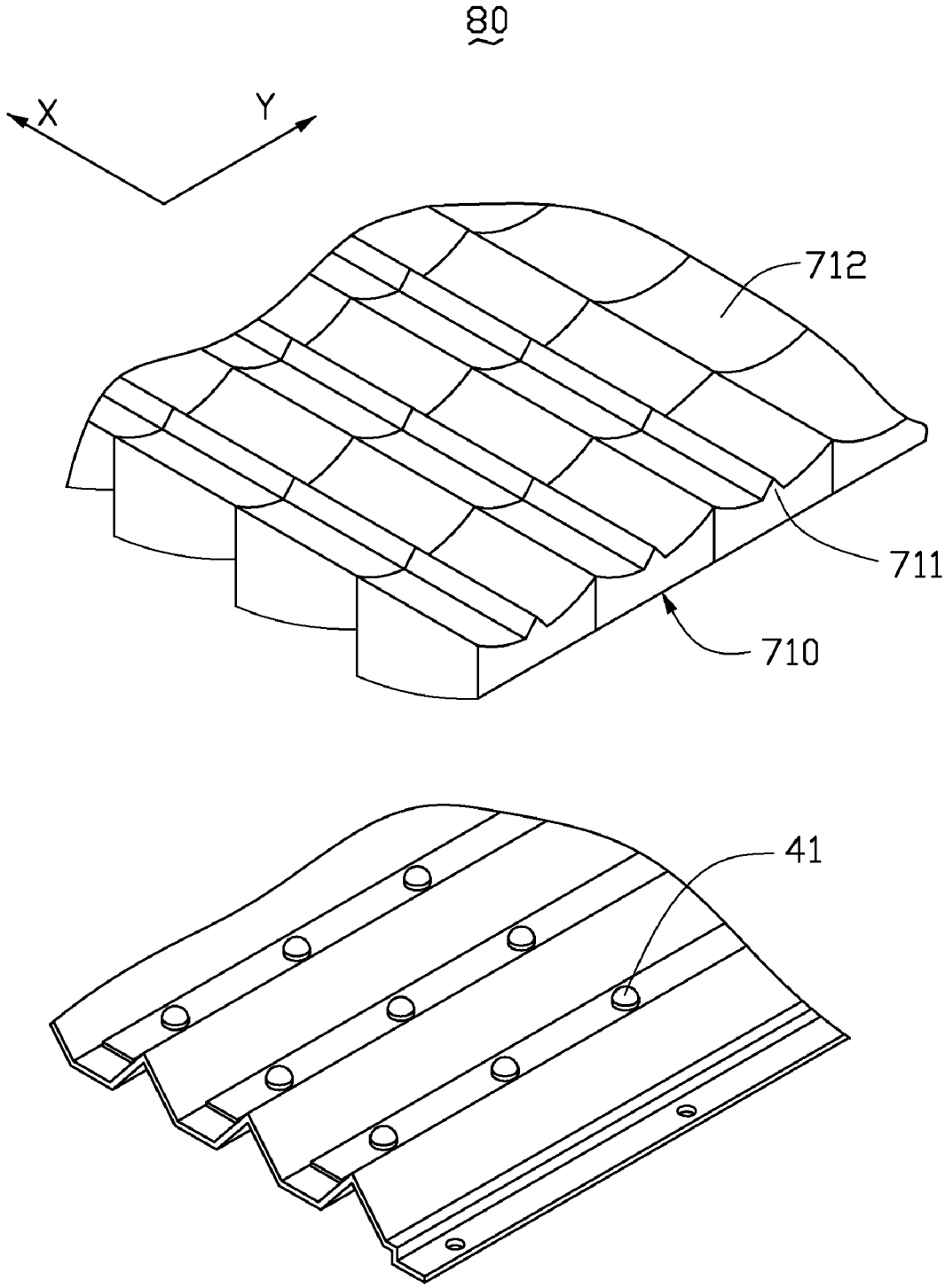
FIG. 8 is an explored, abridged general view of an illumination lamp in accordance with a third exemplary embodiment of the present invention.
Figure 9:
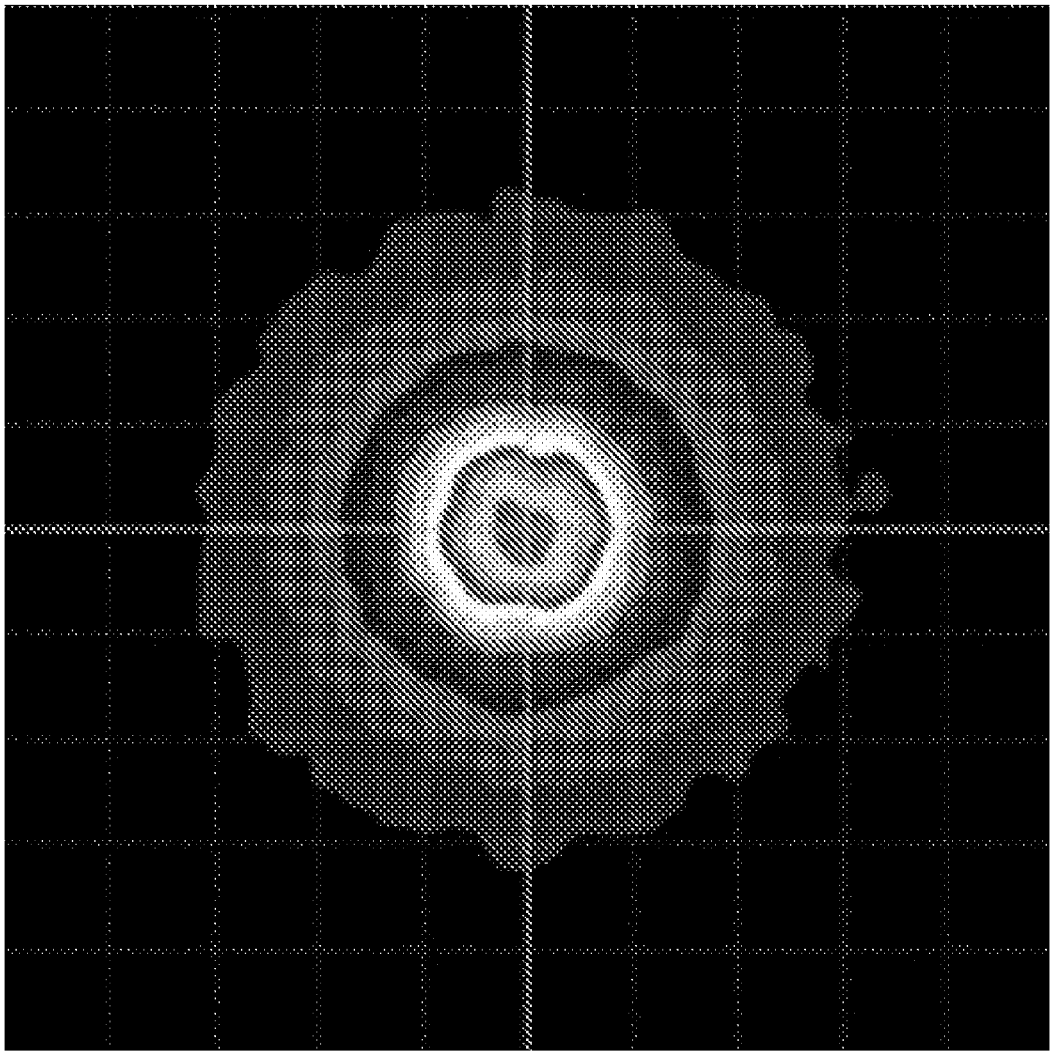
FIG. 9 (RELATED ART)
FIG. 9 shows a simulated view of the light field of a related illumination lamp.
Figure 10:
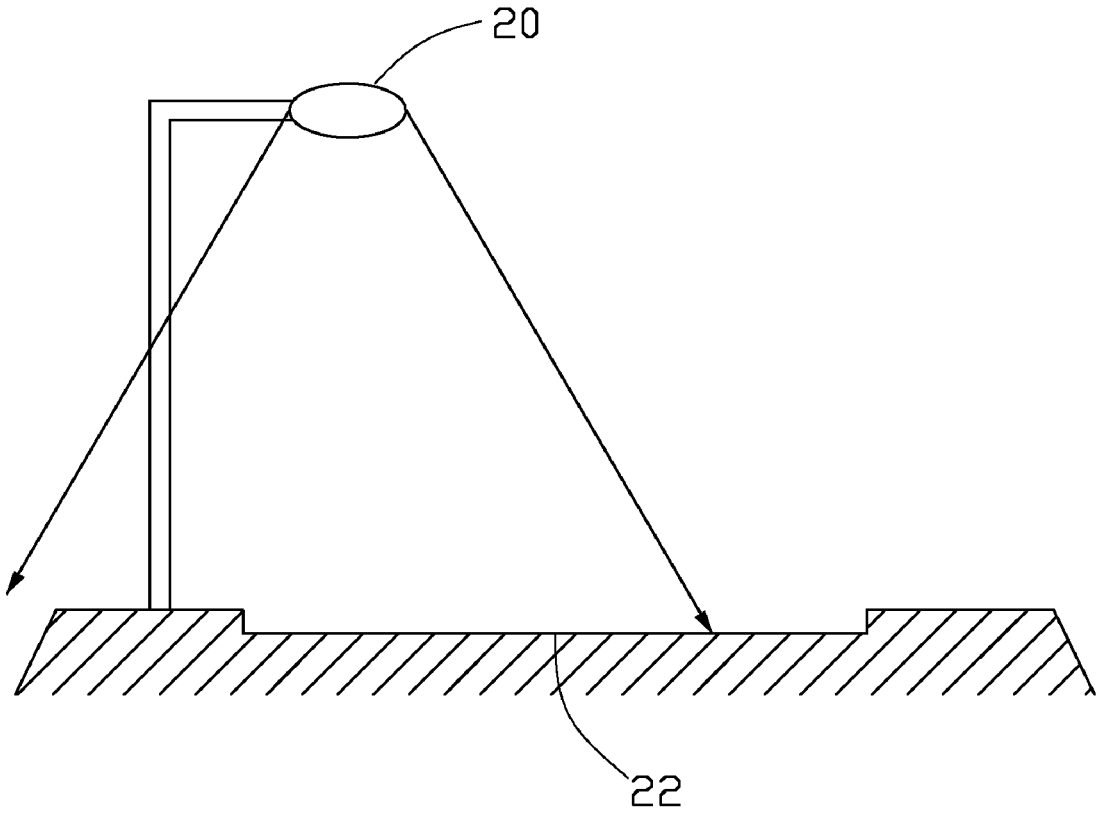
FIG. 10 (RELATED ART)
FIG. 10 shows a light field of the related illumination lamp, which is arranged at one side of a street.

FIG. 8 shows an illumination lamp 80 in accordance with a third embodiment of the present invention. The differences between this embodiment and the first embodiment are that the incidence surface 710 is a convex surface, and the emitting surface 712 is a concave surface. The micro-structure 711 is formed on the concave emitting surface 712.

It can be understood that the above-described embodiment are intended to illustrate rather than limit the invention. Variations may be made to the embodiments and methods without departing from the spirit of the invention. Accordingly, it is appropriate that the appended claims be construed broadly and in a manner consistent with the scope of the invention.

What is claimed is:

1. An illumination lamp comprising:

at least one lighting member for generating light; and a light pervious lamp cover arranged spatially corresponding to the lighting member, the lamp cover having a plurality of lenses arranged in columns and rows, each lens comprising an incidence surface facing the at least one lighting member for receiving the light emitted therefrom, and an emitting surface opposite to the incidence surface, one of the incidence surface and the emitting surface being a convex surface, each lens comprising a first end and an opposite second end in the column direction, a third end and an opposite fourth end in the row direction, a distance between the incidence surface and the emitting surface at the first end is larger than that between the incidence surface and the emitting surface at the second end, wherein the other one of the incidence surface and the emitting surface is a concave surface and the concave surfaces of the lenses in the same row cooperatively form an elongated recess in the row direction.

2. The illumination lamp of claim 1, wherein an elongated micro-structure is formed on each concave surface, the micro-structure being configured for increasing radiating range of the light entering into the lamp cover along the row direction.

3. The illumination lamp of claim 2, wherein the micro-structure is elongated in the row direction.

4. The illumination lamp of claim 3, wherein a cross section of the micro-structure taken along a direction perpendicular to the row direction is triangular.

5. The illumination lamp of claim 1, wherein the row direction and the column direction are perpendicular to each other.

6. The illumination lamp of claim 1 further comprising a reflecting board, the reflecting board being wave-shaped, comprising a plurality of horizontal flat sections and a plurality of serrate sections each interconnecting two neighboring horizontal flat sections, the at least one lighting member being arranged on the horizontal flat sections.

7. The illumination lamp of claim 1, wherein the at least one lighting member includes at least one light emitting diode.

8. The illumination lamp of claim 1, wherein the at least one lighting member comprises an array of light emitting diodes, each light emitting diode being arranged spatially corresponding to the respective lens.

9. A lamp cover comprising:

an array of lenses, each lens comprising an incidence surface for receiving light, and an emitting surface opposite to the incidence surface, one of the incidence surface and the emitting surface being a convex surface, each lens comprising a first end and an opposite second end in a column direction, a third end and an opposite fourth end in a row direction, a distance between the incidence surface and the emitting surface at the first end is larger than that between the incidence surface and the emitting surface at the second end, wherein the other one of the incidence surface and the emitting surface is a concave surface and the concave surfaces of the lenses in the same row cooperatively form an elongated recess in the row direction.

10. The lamp cover of claim 9, wherein an elongated micro-structure is formed on each concave surface, the micro-structure being configured for increasing radiating range of the light entering into the lamp cover along the row direction.

11. The lamp cover of claim 10, wherein the micro-structure is elongated in the row direction.

12. The lamp cover of claim 11, wherein a cross section of the micro-structure taken along a direction perpendicular to the row direction is triangular.

13. The lamp cover of claim 9, wherein the row direction and the column direction are perpendicular to each other.

* * * * *